US006923245B2

(12) United States Patent
Marti et al.

(10) Patent No.: US 6,923,245 B2
(45) Date of Patent: Aug. 2, 2005

(54) METHOD AND DEVICE FOR PRODUCING A METAL STRIP IN A STRIP CASTING MACHINE WITH ROLLS

(75) Inventors: Heinrich Marti, Forch (CH); Jacques Barbe, Tarantaise (FR); Dominique Salathe, Sursee (CH); Alfred Koch, Stansstad (CH)

(73) Assignees: SMS Demag Aktiengesellschaft, Dusseldorf (DE); Main Management Inspiration AG, Hergiswil (CH)

( * ) Notice: Subject to any disclaimer, the term of this patent is extended or adjusted under 35 U.S.C. 154(b) by 0 days.

(21) Appl. No.: 10/489,228

(22) PCT Filed: Sep. 13, 2002

(86) PCT No.: PCT/EP02/10276

§ 371 (c)(1),
(2), (4) Date: Mar. 18, 2004

(87) PCT Pub. No.: WO03/024643

PCT Pub. Date: Mar. 27, 2003

(65) Prior Publication Data

US 2004/0244939 A1 Dec. 9, 2004

(30) Foreign Application Priority Data

Sep. 18, 2001 (CH) ..... 1716/01

(51) Int. Cl.[7] ..... B22D 11/06; B22D 27/02

(52) U.S. Cl. ..... 164/480; 164/428; 164/466; 164/502

(58) Field of Search ..... 164/479–482, 164/427–434, 466–467, 502–503

(56) References Cited

U.S. PATENT DOCUMENTS 5,184,666 A * 2/1993 Gillon et al. ..... 164/466

FOREIGN PATENT DOCUMENTS

| | | | |
|---|---|---|---|
| EP | 0 754 515 | | 1/1997 |
| EP | 0 916 434 | | 5/1999 |
| JP | 11-170005 | * | 6/1999 |

* cited by examiner

*Primary Examiner*—Kuang Y. Lin
(74) *Attorney, Agent, or Firm*—Herbert Dubno

(57) ABSTRACT

The invention concerns a method for producing a metal strip, whereby molten is continuously poured between two casting rolls (1, 2) of a strip casting machine with rolls. Above the molten bath (4) and respectively proximate to the molten bath (5) casting rolls (1, 2) transition surface a rotating magnetic field is produced which generates, in the molten metal, local turbulent flows, so that a surface current is formed in said molten metal, which surface current is directed by the casting rolls (1, 2) towards the central plane (E) of the molten bath (4), that is towards the plane for output of the metal strip (8), thereby enabling to largely prevent supernatant impurities at the surface of the molten bath and oxides located on the surface of the rolls from being deposited, and the molten metal particles from being prematurely solidified.

22 Claims, 5 Drawing Sheets

METHOD AND DEVICE FOR PRODUCING A METAL STRIP IN A STRIP CASTING MACHINE WITH ROLLS

CROSS REFERENCE TO RELATED APPLICATIONS

This application is a national stage of PCT/EP02/10276 filed 13 Sep. 2002 and is based upon Swiss National application 1716/01 filed 18 Sep. 2001 under the International Convention.

FIELD OF THE INVENTION

The invention relates to a method of producing a metal strip by a continuous casting of a metal melt between two casting rolls of a roll strip casting machine and to an apparatus for carrying out the method.

BACKGROUND OF THE INVENTION

In the casting of a metal strip of the type described at the outset, a layer of impurities and oxides floats to the surface of the molten metal bath between casting rolls. In addition, during the feed of the molten metal and the movement of the casting rolls, surface waves and surface streams in the melt result in an upward flotation of the liquid metal and a movement of the impurities onto the casting rolls. As a consequence, there is a danger that parts of the melt will be more intensively cooled on the cooled casting rolls and will prematurely solidify. In addition, the impurities and oxides flush onto the casting roll surfaces from the turbulent molten bath surface and are entrained by the casting rolls. This can create nonuniformities in the strip surface and reduce the strip quality.

OBJECT OF THE INVENTION

The present invention has as its object to provide a method of the type set forth at the outset and an apparatus for carrying out the method which largely eliminate the danger that impurities and oxides will settle out on the casting roll surfaces and the danger of premature solidification of portions of the metal melt.

SUMMARY OF THE INVENTION

These objects are achieved according to the invention by a method of producing a metal strip by continuous casting of a metal melt between two casting rolls of a roll strip casting machine. Above the molten metal bath proximal to the respective interface between the molten metal bath surface and the casting roll respective magnetic rotary fields are generated and thus local eddy currents are formed in the melt such that a surface flow arises in the melt which is directed away from the casting rolls toward the median plane of the molten metal bath, that is toward the outlet plane of the metal strip.

By means of the rotary magnetic field, local eddy currents can be produced in a surface layer of the casting roll which is preferably comprised of nickel, where a slight local temperature increase arises at the casting roll surface which counteracts a premature solidification of the metal melt.

The rotary magnetic field can be produced by coil systems extending along the casting rolls above the molten metal bath with each coil system having a coil carrier on the periphery of which conductors or coils are so arranged and switched that the magnetic field is produced by a multiphasal alternating current which can be regulated as required with respect to frequency and intensity and can be phase shifted, the magnetic rotary field interacting with the field of eddy currents on the molten metal bath surface to displace the melt away from the casting rolls.

The excitation of the coils with multiphasal alternating current can be effected with a sinusoidal, rectangular or other suitable pulse shape. The conductors can be electrically offset through 120° about the periphery of the coil carrier and excited by a three-phase alternating current.

With the spiral pattern of the conductors at the periphery of the coil carrier an additional force component can be produced at the molten metal bath surface and can be oriented counter to force components directed toward the casting roll ends. A separate electronic feed can be provided for the coil systems arranged along the two casting rolls. The positions of the coil systems with reference to the molten metal bath surface can be measured and controlled. By means of a linear conductor arrangement parallel to one another and to the molten metal bath surfaces and at the same distances therefrom, the surface flow in the melt can be increased. The rotational magnetic field can be produced by rotation of a magnet carrier (30*h*; 30*i*) arranged above the molten metal bath along the respective casting roll and provided with a number of cooled permanent magnets. In an apparatus aspect of the invention, above the molten metal bath and along each of the respective casting rolls there is a coil system which includes a fixed coil carrier on the periphery of which a number of multiphasal conductors or coils are carried. The coil carrier can be provided with at least one channel traversed by a cooling medium. The coil carrier can have a circular cross section. The coil carriers can be surrounded by ceramics tubes. The coil carrier at the periphery can have a number of recesses which, together with the inner surface of the ceramic tube, can form a number of cooling passages. The coil carrier can have a parallel surface which is provided with a number of conductors arrayed alongside one another. The coil system can be directly surrounded by a conductor traversed by a cooling medium. Also the coil system can have conductors which are insulated by temperature-resistant oxides. Above the coil system a field shield, preferably of sheet metal or ferrite, can be arranged. Above the melt bath at least one rotatably journaled magnet carrier can be located along each respective casting roll and can have a number of cooled permanent magnets affixed thereto. The magnet carrier can be provided with at least one passage traversed by a cooling medium. The magnet carrier provided with the permanent magnet can be located within a ceramic tube.

In accordance with, the invention, therefore, above the melt bath proximal to the respective melt bath surface/casting roll interface, respective magnetic rotation fields and thus local eddy currents are generated in the melt such that a flat surface current or flow arises in the melt which is directed away from the casting rolls toward a median plane of the melt bath, that is toward the outlet phase of the melt bath and, with a limited energy expenditure, hinders the undesired premature solidification of the parts of the metal melt along the casting roll edges. The impurities and oxides are transported away from the casting roll.

BRIEF DESCRIPTION OF THE DRAWING

The invention is described below in greater detail in connection with the drawing. The Figures of the drawing show purely diagrammatically.

SPECIFIC DESCRIPTION

Figure 1:
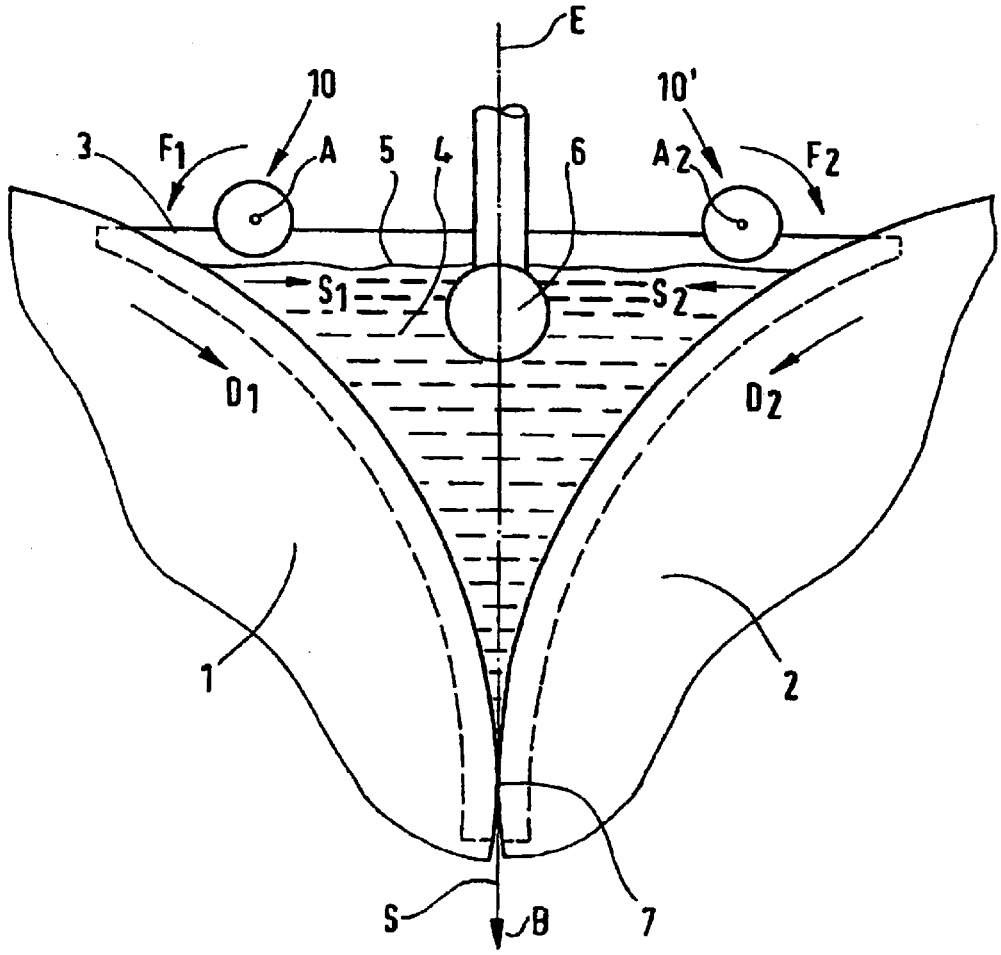
FIG. 1: two casting rolls of a roll strip casting machine with a molten metal bath between them and with the respective devices for generating a surface flow in the melt respectively located above the melt bath surface and juxtaposed with each casting roll and extending along the respective casting roll.

In FIG. 1 two casting rolls 1 and 2 are indicated which are rotatable about horizontal axes and whose rotation directions have been designated with D1 and D2. To produce a metal strip 8, between the two casting rolls 1 and 2 and two lateral seals 3 provided at the lateral end regions of the casting rolls 1 and 2, a molten metal is poured by a pouring device 6 or pourer 6 which will not be described in greater detail. The molten metal bath is designated at 4 in FIG. 1 and its upper surface with the reference numeral 5. The metal strip 8 which is produced is formed in the throughgoing gap 7 between the two cooled casting rolls 1, 2 and is displaced in the direction of the arrow B. The outlet plane of the metal strip 8 corresponds to the median plane E of the molten metal bath 4 in which the pourer 6 lies.

Above the molten metal bath surface 5, according to the invention, proximal to the casting roll surfaces, devices 10, 10' are disposed to produce magnetic rotary fields which extend along the casting rolls 1, 2. Various embodiments of these devices are described in greater detail in conjunction with FIG. 2–9. The directions of rotation or senses of the magnetic rotary fields have been represented in FIG. 1 at F1, F2 and have rotation axes A1, A2. As a consequence of the magnetic rotary field, in the electrically conductive metal melt, local electrical eddy currents are produced which apply forces to the conductive melt so that, in the melt, surface flows arise which are directed (see arrows S1, S2) away from the casting rolls 1, 2 toward the median plane E of the molten metal bath 4. The surface flows prevent, on the one hand, premature and undesired solidification of parts of the melt at the casting roll surface/melt bath surface interface and, on the other hand, the settling out of impurities and oxides on the casting roll surfaces and their entrainment by the casting rolls 1, 2. The impurities and oxides are transported away from the casting roll and can be removed along the pourer 6 which is located in the media plane E.

As is known, the casting rollers 1, 2 can be provided on their surfaces as a rule with a nickel coating. Eddy currents are also generated in this nickel coating by means of the magnetic rotary fields and give rise locally to a slight temperature increase which additionally reduces the premature hardening of the melt on the cool roll surfaces. Below, various embodiments of the devices 10, 10' for generating the magnetic rotary fields are described based upon FIGS. 2 to 9.

Figure 2:
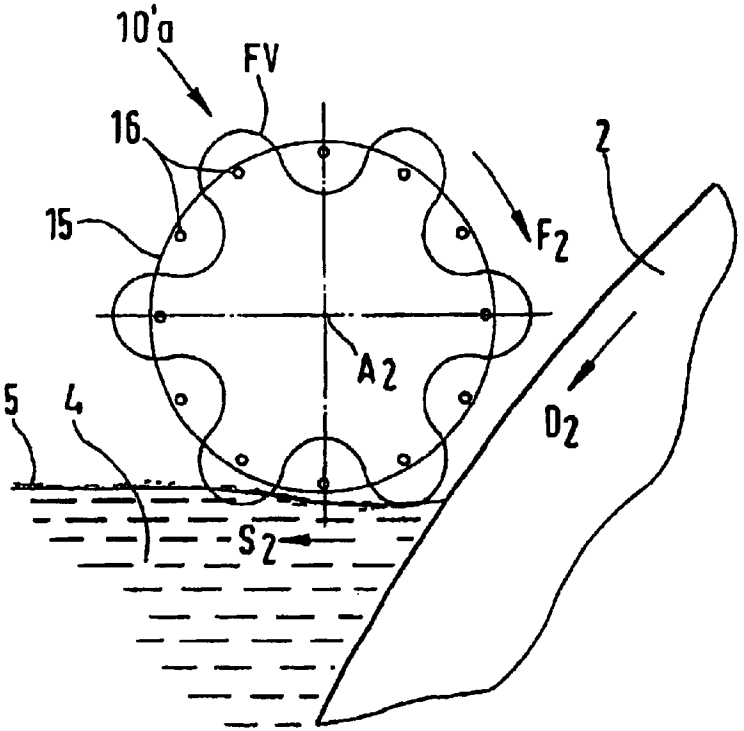

FIG. 2 shows a coil system 10'a which extends along the casting roll 2 and is arranged above the molten metal bath 4 proximal to the interface between the molten metal bath surface 5 and the casting roll 2 and which comprises a coil carrier 15 of circular cross section which is fixed in place and has a number of conductors 16 or coils arranged around its periphery. These are so switched that with a multiphase excitation using phase-shifted alternating current, a rotary magnetic field having a rotational sense F2 is produced whose pattern is indicated by the line FV. The rotation axis A2 of this rotary filed coincides with the axis of the coil carrier 15. As has already been indicated, the metal melt on the molten metal bath surface 5 is displaced by the interaction of the rotary field with the field produced by electric eddy currents generated in the melt away from the casting roll 2 in the direction of arrow S2 and is pressed flat. The surface of the melt is thereby calmed and the upward flapping of the liquid metal and the impurities onto the surfaces of the casting rolls is hindered. The impurities and oxides are displaced toward the median plane E of the molten metal bath 4 by electronic feed of the coil system 10'a.

The excitation of the coil can advantageously be effected with a controlled frequency and intensity as a function of the casting parameters. Preferably the feed of the coil system 10'a and the feed of the opposite coil system juxtaposed with the other casting roll 1 can be separate from one another and for the purpose multiphasal controllable electronic feed sources which are known per se can be used. As a result, the field strength and the frequency can optimally be matched to the requirements of the process. In addition the position of the respective coil systems above the melt bath surface 5 can be detected by appropriate sensors which can be used to optimally control the process.

The excitation of the coils can be effected with a mutiphasal alternating current with sine-shaped, rectangular-shaped or another suitable pulse wave form.

Figure 3:
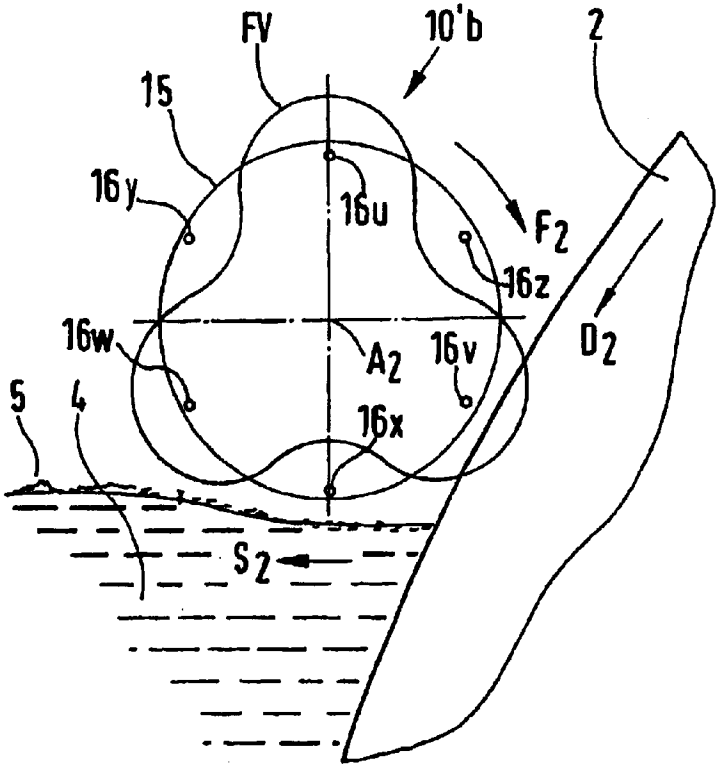
FIGS. 2 to 9: different embodiments of the apparatus of FIG. 1.

FIG. 3 shows a coil system 10'*b* with coils electrically offset through 120° (see conductors 16*x*, 16*y*, 16*z*; 16*u*, 16*v*, 16*w* on the periphery of the coil carrier 15) which is excited by means of a three-phase alternating current.

Figure 4:
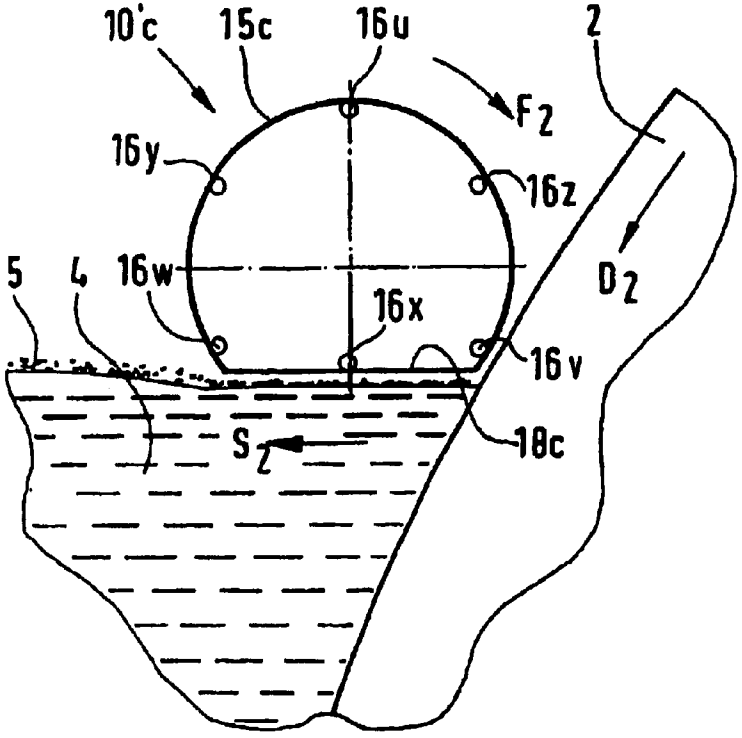

According to FIG. 4 another coil carrier 15*c* which is fixed in place has a coil system 10'*c* with a lower surface 18*c* provided so as to be juxtapoxed with a molten bath surface 5 and parallel to the latter, which has a plurality, preferably three, conductors 16*w*, 16*x*, 16*v* which are parallel to and equispaced from the molten melt bath surface 5 whereby the electric current effect in the melt is additionally amplified (compare arrow S2).

Figure 5:
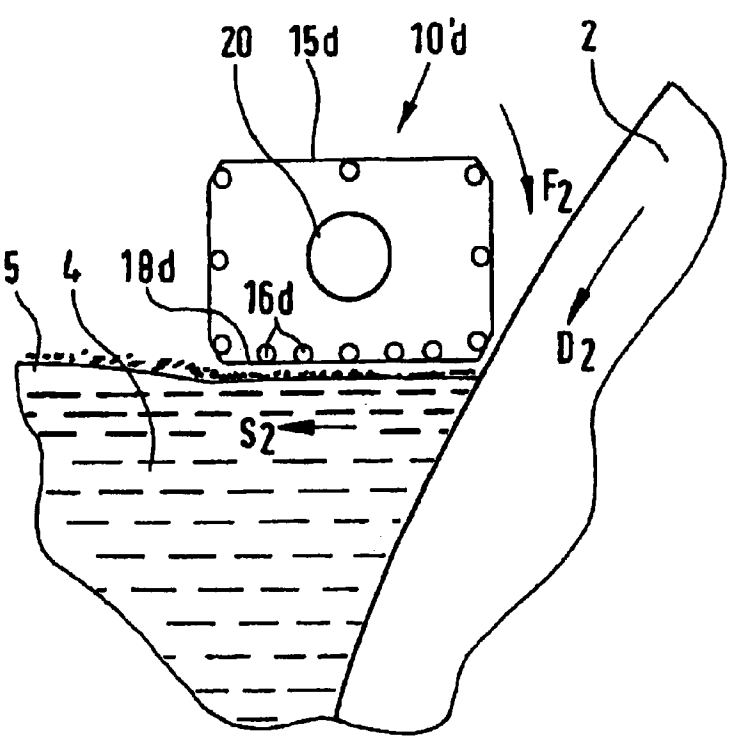

The same effect is achieved by the coil system illustrated in FIG. 5 at 10'*d* which has the rectangular cross section of a coil carrier 15*d*, whereby again the lower surface turned toward the melt bath surface 5 has a number of conductors 16*d* which are parallel to one another and to the molten metal bath 5 and are equispaced therefrom. The coil carrier 15*d* has a central passage 20 tranversed by a cooling medium. The cooling of the coil system is effected preferably with the otherwise available inert cooling gas so that the cooling gas is low. If higher power of the coil system are required, then the cooling medium can be nitrogen in liquid form.

Figure 6:
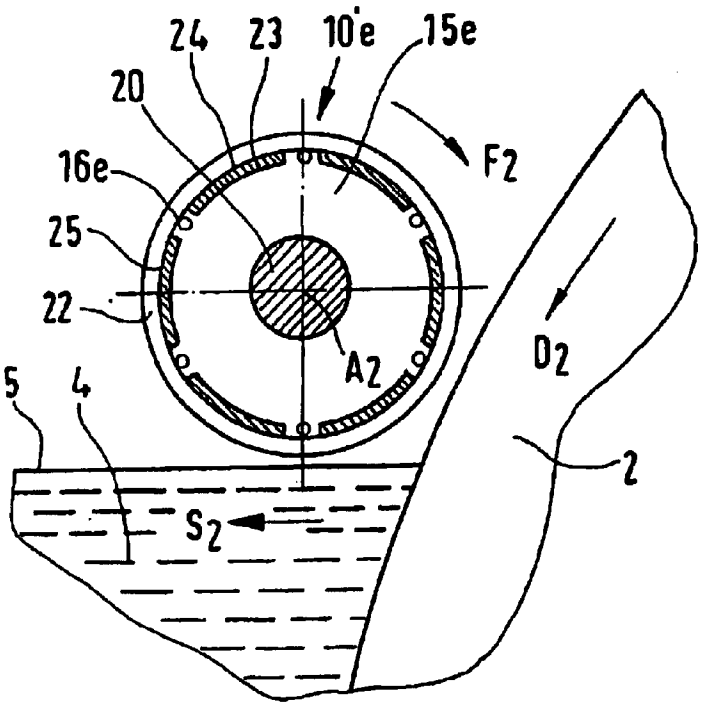

A central passage 20 traversed by the cooling medium is also possessed by the coil carrier 15*e* of the coil system 10'*e* illustrated in FIG. 6. The cross section is here again of circular shape and is provided at its periphery with a coil carrier 15*e* provided with conductors 16*e* and disposed within a ceramic tube 22. The coil carrier 15*e'* is further provided with a number of cutouts 23, preferably six in number, distributed over the periphery and which together with the inner surface 24 of the ceramic tube 22 define a number of cooling passages traversed by the cooling medium.

Figure 7:
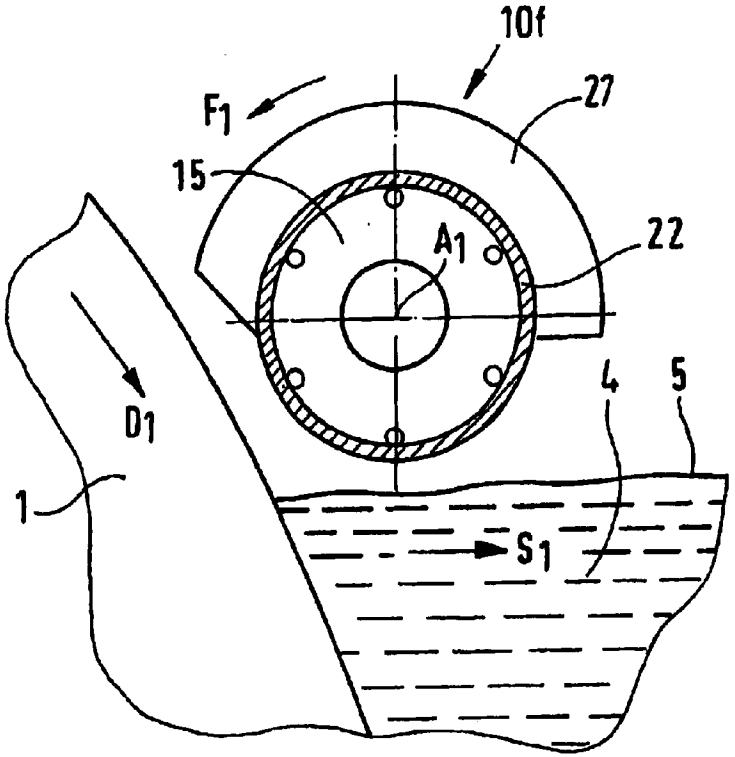

The coil system 10*f* of FIG. 7 encompasses externally the coil carrier 15 which is again provided in a ceramic tube and which provides a field shielding 27 comprised preferably of steel sheet or ferrite.

With all of the aforementioned coil systems, the conductors are preferably insulated with a temperature-resistant oxide (for example a pyrothenaxone insulation). The conductors can also be directly transversed by a cooling medium. The excitation of the coils is obtainable with small section cable feeds.

It is especially advantageous to have the conductor or coil at the periphery of the coil carrier run in a spiral pattern. In that case the melt receives an additional force component that is directed away from the side seal or side seals and which is used to transport away impurities and oxides.

Figure 9:
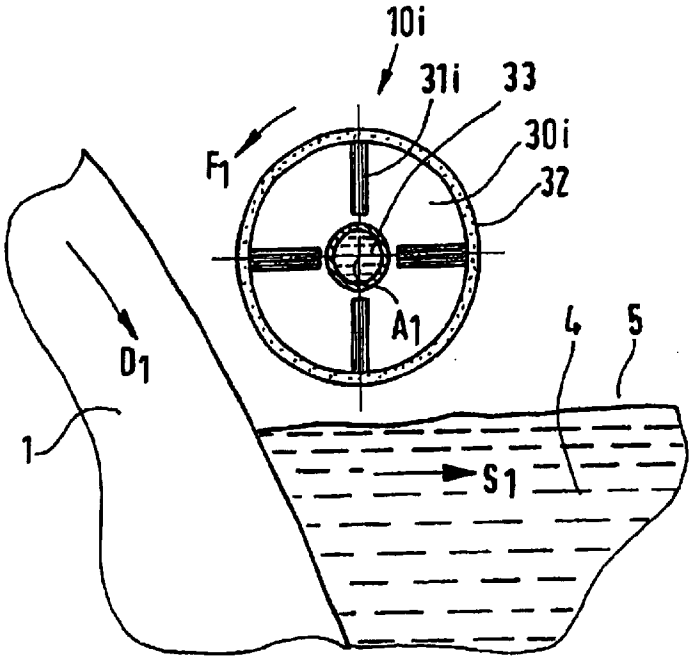
Figure 8:
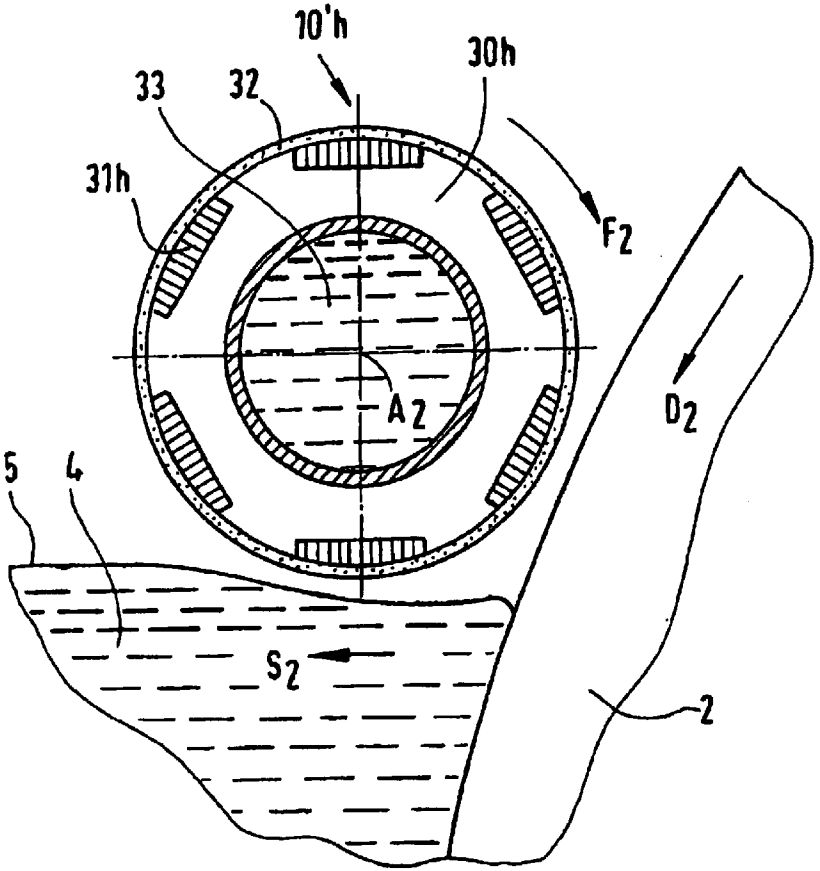

Another kind of device 10'*h*, 10*i* for generating magnetic rotary fields is illustrated in FIGS. 8 and 9. Instead of locally fixed coil systems, above the molten metal bath surface 5 rotary magnetic carriers 30*h* or 30*i* are arranged along respective casting rolls and have a number of cooled permanent magnets 31*h* or 31*i* affixed to them. As a result of the rotation of the permanent magnet arrangement magnetic rotary fields are produced which interact with the local eddy currents and bring about the desired flow of the melt. In addition, local eddy currents can thereby be generated in the surface nickel coating of the passing roll 1, 2, which results in a slight local temperature increase at the casting roll surfaces and counteracts premature solidification of the melt at these locations.

The magnetic carriers 30*h*, 30*i* also have each a respective central channel 33 traversed by a cooling medium or have cooling openings otherwise and are surrounded by a ceramic tube 32.

In the variant shown in FIG. 8, the permanent magnets 31*h* are arranged peripherally on the magnet carrier 30*h*. In the embodiment according to FIG. 9, the permanent magnets 31*i* are arranged radially of the rotation axis A1 of the magnet carrier 30*i*. The rotation axis A2 or A1 of the magnet carriers 30*h* or 30*i* are in both variants simultaneously the rotation axes of the rotary magnetic field.

The method accordion to the invention and the apparatus according to the invention for carrying out the method enable a substantial increase in the quality of the metal strip to be produced and is simple from the point of view of operation technology and is cost effective.

With this method, in addition, there is a damping and flattening of the surface in the liquid region so that straight solidification lines are obtainable. The two devices 10 and 10' are preferably so controlled that they form solidification lines of the same height.

What is claimed is:

1. A method of producing a metal strip comprising the steps of:

continuously casting a metal melt between two rotating casting rolls of a roll strip casting machine, to form a continuously cast strip;

maintaining a bath of the metal melt between the casting rolls for incorporation progressively into said strip;

above the melt bath proximal to a respective interface between surface of the bath and each casting roll, generating respective magnetic rotary fields and forming local eddy currents in the melt such that a surface flow arises in the melt which is directed away from the casting rolls toward a median plane of the bath and toward the outlet plane of the metal strip.

2. The method according to claim 1, wherein the rotary magnetic fields produce local eddy currents in a surface layer of the casting roll comprised of nickel to generate a slight local temperature increase at the casting roll surfaces sufficient to counteract a premature solidification of the metal melt.

3. The method according to claim 1, wherein the rotary magnetic fields are produced by coil systems provided to extend along the casting rolls above the molten metal bath with each coil system having a coil carrier on a periphery of which conductors or coils are so arranged and switched that the magnetic field is produced by a multiphasal alternating current which is regulated as required with respect to frequency, intensity and phase shift, the magnetic rotary fields interacting with fields of eddy currents on the molten metal bath surface to displace the melt away from the casting rolls.

4. The method according to claim 3, wherein the excitation of the coils with multiphasal alternating current is effected with a sinusoidal or rectangular pulse shape.

5. The method according to claim 3 wherein the conductors are electrically offset through 120° about the periphery of the coil carrier and are excited by a three-phase alternating current.

6. The method according to claim 3 wherein the conductors have a spiral pattern at the periphery of the coil carrier producing an additional force component at the bath surface and oriented counter to force components directed toward ends of the casting rolls.

7. The method according to claim 3 wherein a separate electronic feed is provided for coil systems arranged along the two casting rolls.

8. The method according to claim 7 comprising measuring and controlling positions of the coil systems with reference to the molten metal bath surface.

9. The method according to claim 1, further comprising the step of providing a linear conductor arrangement parallel to one another and to the molten metal bath surface and at the same distances therefrom to increase surface flow in the melt.

10. The method according to claim 1 wherein the rotational magnetic field is produced by rotation of a magnet carrier arranged above the molten metal bath along the respective casting roll and provided with an number of cooled permanent magnets (31*h*; 31*i*).

11. An apparatus for producing a continuously cast metal strip, comprising:

a pair of rotatable casting rolls between which continuously cast metal strip is formed at an outlet between the rolls;

a feeder supplying molten metal to a molten metal bath between the rolls above said outlet; and above the molten metal bath and along each of the casting rolls respective a coil system which includes a fixed coil carrier on a periphery of which a number of multiphasal conductors or coils are carried, whereby rotary magnetic fields are produced generating local eddy current in a surface of the bath inducing a flow of metal away from the rolls toward a plane of said outlet.

12. The apparatus according to claim 11 wherein the coil carrier is provided with at least one channel traverse by a cooling medium.

13. The apparatus according to claim 11 wherein the coil carriers have circular cross section.

14. The apparatus according to claim 11, wherein the coil carriers are surrounded by ceramic tubes.

15. The apparatus according to claim 14 wherein each the coil carrier at the periphery has a number of recesses which, together with an inner surface of the respective ceramic tube forms a number of cooling passages.

16. The apparatus according to claim 11 wherein each coil carrier has a flat surface which is provided with a number of conductors arrayed alongside one another.

17. The apparatus according to claim 11 wherein the coil system has a conductor flown through by a cooling medium.

18. The apparatus according to claim 11 wherein the coil system has conductors which are insulated by temperature-resistant oxides.

19. The apparatus according to claim 11, wherein above the coil system a field shield of sheet metal or ferrite is arranged.

20. An apparatus for producing a metal strip, comprising:

a pair of rotatable casting rolls between which a continuously cast metal strip is formed at an outlet between the rolls;

a feeder supplying molten metal to a molten metal bath between the rolls above said outlet;

at least one rotatably journaled magnet carrier arranged along each of said casting rolls; and a plurality of permanent magnets affixed to each carrier for generating, upon rotation of the respective carrier respective magnetic rotary fields at a surface of said bath, thereby forming local eddy currents in the melt of said bath such that surface flow arises in the melt which is directed away from the casting rolls toward a median plane of the bath and toward an outlet plane of the metal strip.

21. The apparatus defined in claim 20 wherein each of said magnet carriers is provided with at least one passage flown through by a cooling medium.

22. The apparatus defined in claim 20 wherein each of said magnetic carriers is provided with respective permanent magnets located within a ceramic tube.

* * * * *